US011320228B2

(12) United States Patent
Valdez

(10) Patent No.: US 11,320,228 B2
(45) Date of Patent: May 3, 2022

(54) SIMULATED HUNTING DEVICES AND METHODS

(71) Applicant: Ronnie A. Valdez, Denver, CO (US)

(72) Inventor: Ronnie A. Valdez, Denver, CO (US)

( * ) Notice: Subject to any disclaimer, the term of this patent is extended or adjusted under 35 U.S.C. 154(b) by 265 days.

(21) Appl. No.: 16/680,692

(22) Filed: Nov. 12, 2019

(65) Prior Publication Data

US 2020/0096283 A1 Mar. 26, 2020

Related U.S. Application Data

(63) Continuation of application No. 14/666,153, filed on Mar. 23, 2015, now Pat. No. 10,508,882.

(51) Int. Cl.
*F41A 33/02* (2006.01)
*F41A 33/04* (2006.01)

(52) U.S. Cl.
CPC ..... *F41A 33/02* (2013.01); *F41A 33/04* (2013.01)

(58) Field of Classification Search
CPC ..... F41A 33/00; F41A 33/02; F41A 33/04; F41A 33/06; F41G 3/26; F41G 3/2655
See application file for complete search history.

(56) References Cited

U.S. PATENT DOCUMENTS 3,657,826 A 4/1972 Marshall et al.
3,748,751 A 7/1973 Breglia et al.
4,015,258 A 3/1977 Smith et al.
4,640,514 A 2/1987 Myllyla et al.
4,989,024 A 1/1991 Myers
5,020,262 A 6/1991 Pena
5,591,032 A 1/1997 Powell et al.
5,641,288 A 6/1997 Zaenglein et al.
5,771,623 A 6/1998 Pernstich et al.
6,000,163 A 12/1999 Gordon
6,363,223 B1 3/2002 Gordon
6,450,816 B1 9/2002 Gerber
6,575,753 B2 6/2003 Rosa et al.
6,863,532 B1 3/2005 Ambrosoli
7,329,127 B2 2/2008 Kendir et al.
7,677,893 B2 3/2010 Lvovskiy
8,469,824 B1 6/2013 Farley et al.
8,613,619 B1 12/2013 Couet et al.
8,777,226 B1 7/2014 Decker, Jr.
9,526,239 B2 12/2016 Valdez
9,605,927 B2 3/2017 Otte et al.
(Continued)

OTHER PUBLICATIONS

Arsenalrobelt "Cabela's Big Game Hunter Pro Hunts—Gameplay Walkthrough—Part 2—Free Hunt." Published on Youtube on Mar. 27, 2014. Retrieved from <https://www.youtube.com/watch?v=ClzjO94EMEs>.

(Continued)

*Primary Examiner* — Timothy A Musselman
(74) *Attorney, Agent, or Firm* — Faegre Drinker Biddle & Reath LLP

(57) ABSTRACT

The present disclosure relates to simulated hunting devices and methods, and in particular to an accessory for a real or toy firearm that provides a simulated hunting experience in a real hunting environment. A hunting simulation accessory can be attached to a real or toy firearm, such as by attaching the accessory to an accessory rail along the barrel of the firearm. The simulation accessory provides audio and visual responses to the user to simulate a hunting experience, even when no live ammunition is fired.

14 Claims, 4 Drawing Sheets

(56) References Cited

U.S. PATENT DOCUMENTS

| | | | |
|---|---|---|---|
| 9,694,290 | B2 | 7/2017 | Valdez |
| 10,508,882 | B2 | 12/2019 | Valdez |
| 2002/0002788 | A1 | 1/2002 | Hope |
| 2002/0009694 | A1 | 1/2002 | Rosa |
| 2002/0051953 | A1 | 5/2002 | Clark et al. |
| 2002/0071050 | A1 | 6/2002 | Holmberg |
| 2003/0022135 | A1 | 1/2003 | Shechter et al. |
| 2003/0101604 | A1 | 6/2003 | McGivern |
| 2004/0031184 | A1 | 2/2004 | Hope |
| 2004/0231220 | A1 | 11/2004 | McCormick |
| 2005/0153262 | A1 | 7/2005 | Kendir |
| 2005/0219690 | A1 | 10/2005 | Lin et al. |
| 2005/0246910 | A1 | 11/2005 | Mowers |
| 2006/0043259 | A1 | 3/2006 | Thompson |
| 2006/0201046 | A1 | 9/2006 | Gordon |
| 2006/0265929 | A1 | 11/2006 | Haney |
| 2007/0190495 | A1 | 8/2007 | Kendir et al. |
| 2008/0107414 | A1 | 5/2008 | Showalter |
| 2008/0233543 | A1 | 9/2008 | Guissin |
| 2009/0045579 | A1 | 2/2009 | Broadley |
| 2009/0111073 | A1 | 4/2009 | Stanley |
| 2009/0205239 | A1 | 8/2009 | Smith, III |
| 2010/0093436 | A1 | 4/2010 | Lander |
| 2010/0173686 | A1 | 7/2010 | Grant et al. |
| 2011/0275435 | A1 | 11/2011 | Torre et al. |
| 2012/0050714 | A1 | 3/2012 | McConville et al. |
| 2012/0148989 | A1 | 6/2012 | Lvovskiy et al. |
| 2012/0251982 | A1 | 10/2012 | Hester et al. |
| 2012/0262484 | A1 | 10/2012 | Gottfeld et al. |
| 2013/0040268 | A1 | 2/2013 | Van der Walt et al. |
| 2013/0273504 | A1 | 10/2013 | Carter |
| 2013/0288743 | A1 | 10/2013 | Hunt et al. |
| 2013/0319216 | A1 | 12/2013 | Poirier et al. |
| 2014/0038136 | A1 | 2/2014 | Hamilton et al. |
| 2014/0045146 | A1 | 2/2014 | Otte et al. |
| 2014/0109458 | A1 | 4/2014 | Maryfield et al. |
| 2014/0165447 | A1 | 6/2014 | McHale et al. |
| 2014/0272807 | A1 | 9/2014 | Guenther et al. |
| 2015/0010887 | A1 | 1/2015 | Foege |
| 2015/0125828 | A1 | 5/2015 | Otte et al. |
| 2015/0247702 | A1 | 9/2015 | Davidson et al. |
| 2015/0260474 | A1 | 9/2015 | Rublowsky et al. |
| 2015/0267991 | A1 | 9/2015 | Foege |
| 2015/0276349 | A1 | 10/2015 | Northrup et al. |
| 2015/0345906 | A1 | 12/2015 | Varshneya et al. |
| 2016/0084617 | A1 | 3/2016 | Lyren |
| 2016/0169608 | A1 | 6/2016 | Schulz et al. |
| 2016/0252326 | A1 | 9/2016 | Jones et al. |
| 2016/0282076 | A1 | 9/2016 | Valdez |
| 2017/0108376 | A1 | 4/2017 | Maryfield et al. |
| 2017/0219693 | A1 | 8/2017 | Choiniere et al. |

OTHER PUBLICATIONS

Coxworth, Ben. "Camera gun would let "harmless hunters" get killer wildlife shots". <https://newatlas.com/kill-shot-camera-hunting-rifle/21802/>. 5 pages. Report dated Mar. 12, 2012.

SIMULATED HUNTING DEVICES AND METHODS

CROSS-REFERENCE TO RELATED APPLICATION

This application is a continuation of U.S. application Ser. No. 14/666,153, filed Mar. 23, 2015, now U.S. Pat. No. 10,508,882, and titled "SIMULATED HUNTING DEVICES AND METHODS," the entire contents of which are incorporated herein by reference for all purposes.

FIELD

The present disclosure relates to simulated hunting devices and methods, and in particular to an accessory for a real or toy firearm that provides a simulated hunting experience in a real hunting environment.

BACKGROUND

Game hunting is a popular recreational pastime in the United States and many other countries worldwide. However, hunting regulations have become increasingly strict, limiting the duration and scope of hunting activities to particular animals, geographic areas, and other limits. In addition, some hunters prefer to participate in outdoor activities without killing or injuring animals.

SUMMARY

The present disclosure relates to simulated hunting devices and methods, and in particular to an accessory for a real or toy firearm that provides a simulated hunting experience in a real hunting environment. A hunting simulation accessory can be attached to a real or toy firearm, such as by attaching the accessory to an accessory rail along the barrel of the firearm. The simulation accessory provides audio and visual responses to the user to simulate a hunting experience, even when no live ammunition is fired.

In an embodiment, a hunting simulation accessory includes a housing with a mount that interfaces with a functional or non-functional firearm. The accessory also includes a sensor compressible by the firearm trigger to generate a trigger signal. The accessory also includes a laser module with an emitter oriented to emit a laser toward an object, and a detector responsive to light reflected from the object. The accessory also includes a display screen and a processor configured to receive the trigger signal, provide a first user feedback, activate the emitter, receive a signal from the detector, and provide a second user feedback.

In an embodiment, a method for simulating a hunting experience includes receiving a signal from a trigger of a functional or non-functional firearm, and then generating a first user feedback, which could include a first audible, visual, or tactile response. The method includes emitting a laser along a line of sight of the firearm, detecting a reflected laser, and then generating a second user feedback different from the first.

DETAILED DESCRIPTION

The present disclosure relates to simulated hunting devices and methods, and in particular to an accessory for a real or toy firearm that provides a simulated hunting experience in a real hunting environment. A hunting simulation accessory can be attached to a real or toy firearm, such as by attaching the accessory to an accessory rail along the barrel of the firearm. The simulation accessory provides audio and visual responses to the user to simulate a hunting experience, even when no live ammunition is fired. Embodiments of the present invention may be used alone or in conjunction with the apparatus and methods described in U.S. Patent Publication No. 2014/0323187, the contents of which are incorporated by reference in their entireties.

For example, in an embodiment, the hunting simulation accessory includes a laser module at one end of a housing, facing along the barrel of the firearm, and a video screen at the opposite end, facing the user. A sensor such as a pressure sensor is positioned behind the trigger of the firearm and is connected to the housing with a cable. When the user pulls the trigger, the sensor sends a signal to a processor, which generates a first feedback to simulate the discharge of the firearm, such as playing the sound of fired ammunition. The laser module emits a laser along the barrel toward the object in the user's aim. If the laser hits the target, it is reflected back to and detected by the laser module, resulting in a second feedback to the user to confirm the successful shot. The second feedback can include a video selected by the user, such as a video of a bird falling to the ground after being shot. With this accessory, the user can fully participate in an outdoor hunting activity, including tracking, aiming, and firing at live animals and viewing a resulting video, without actually firing any live ammunition and without causing harm to any animals.

Figure 1:
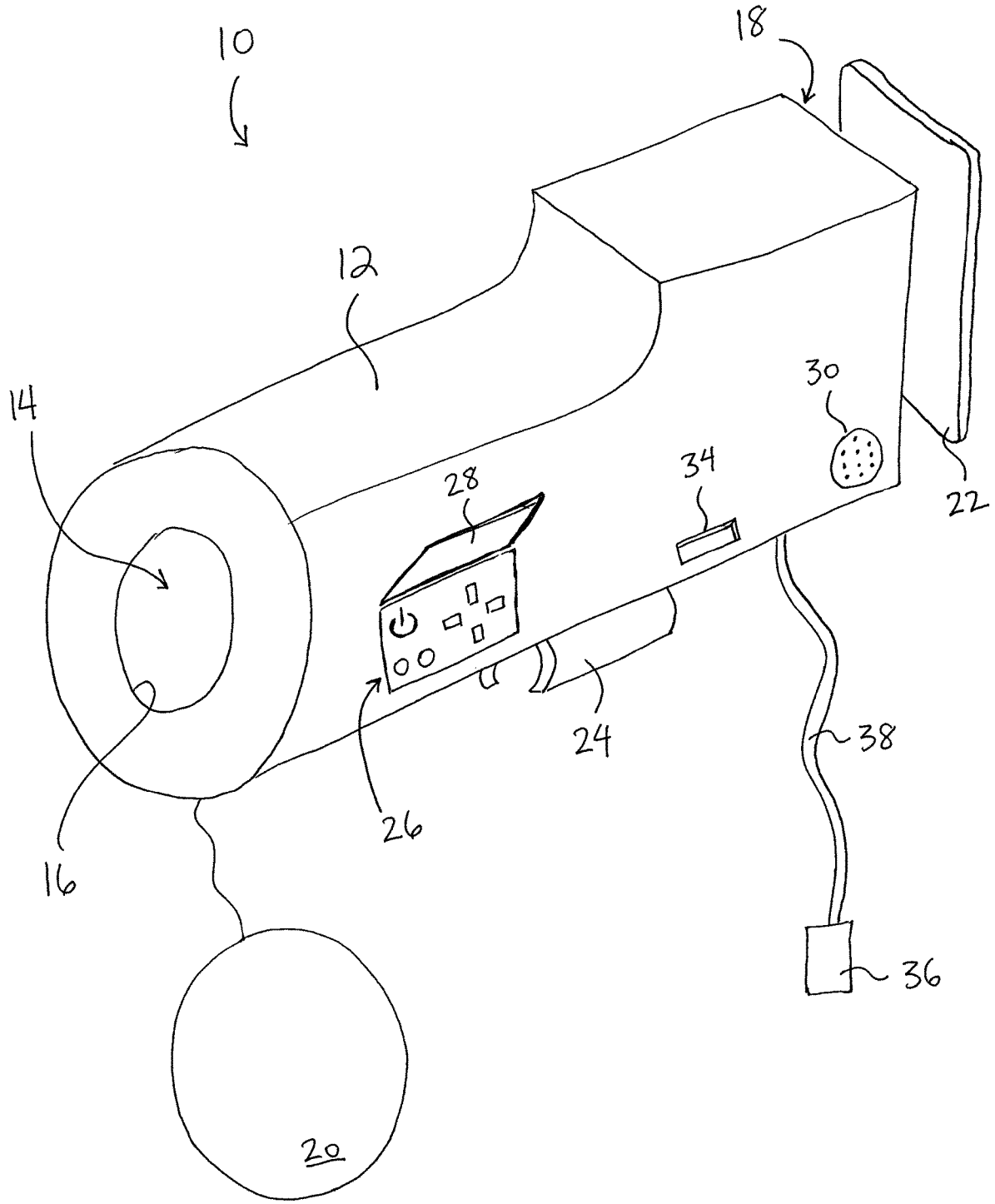
FIG. 1 illustrates a perspective view of a hunting simulation accessory, according to an embodiment of the present disclosure.

A hunting simulation accessory 10 according to an embodiment is shown in FIG. 1. The hunting simulation accessory 10 includes a housing 12 that encloses many of the electrical components of the system. A laser module 14 is positioned near a first, forward end of the housing 12, and is oriented to emit a laser through an opening 16 in the front end of the housing. At the opposite end of the housing is a display screen 18, which displays images and/or video files to the user, and/or can receive user inputs. Optionally, the accessory unit may include covers 20, 22 for the front of the laser and the display screen, respectively. In an embodiment, the housing 12 is 7 inches or less in diameter, and may be rectangular or cylindrical in cross-section, or a combination of shapes.

The housing 12 includes a mount 24 along one side of the housing, for attaching the accessory unit 10 to a firearm. The mount 24 may be a track or groove for interfacing with a standard firearm accessory rail (such as rail 54 shown in FIG. 3), or may be other types of mechanical mounts such as a strap, twist knob, clip, or other suitable fasteners. The mount 24 orients the housing 12 along the barrel of the firearm, such that the laser module 14 inside the housing is aimed along the line of sight of the barrel of the firearm, to aim the laser in the same direction that the user is aiming the firearm.

The housing 12 also includes a user input 26 such as a keypad with a plurality of buttons or keys the user can press, and optionally a cover 28 that can close over the keypad. In another embodiment, the display screen 18 is a touch screen, and the user input 26 is part of the display screen 18 rather than a separate keypad. The display screen displays videos or images to the user and also accepts input from the user via the user's touch interaction with a menu on the touch screen.

The housing 12 also includes a speaker 30 for playing sounds, and a vibrator 32 (shown in FIG. 2) for providing a tactile response to the user. Additionally, the housing 12 includes a data port 34 such as a USB or serial port, or a memory card, to enable the user to transfer data files to the accessory unit. The user can download sounds, images, or video files to the accessory unit 10 through the data port 34, so that the accessory 10 can play custom sounds and display custom images or videos that the user prefers during a hunting activity. The data port 34 may also be used to provide software updates to the accessory unit 10.

As shown in FIG. 1, the accessory 10 also includes a sensor 36 connected to the housing 12 by a cable 38. The sensor 36 is designed to interact with the trigger of the firearm (such as trigger 52 shown in FIG. 3), to generate a signal when the trigger is pulled. In an embodiment, the sensor 36 is a pressure sensor or pressure clip that generates a signal when the user presses the trigger against the sensor. When the trigger is pulled, it compresses the sensor, which completes a circuit sending a signal to the housing. The sensor could be an optical sensor or simple mechanical switch or other suitable types of sensors. The sensor sends a signal along the cable 38, and the cable plugs into a cable intake port 39 (see FIG. 2) in the housing 12. Alternatively, the sensor sends a signal wirelessly to the accessory device 10. When the sensor 36 is a wireless sensor, the accessory 10 includes a wireless transceiver 40 (see FIG. 2) for communicating with the sensor.

Figure 2:
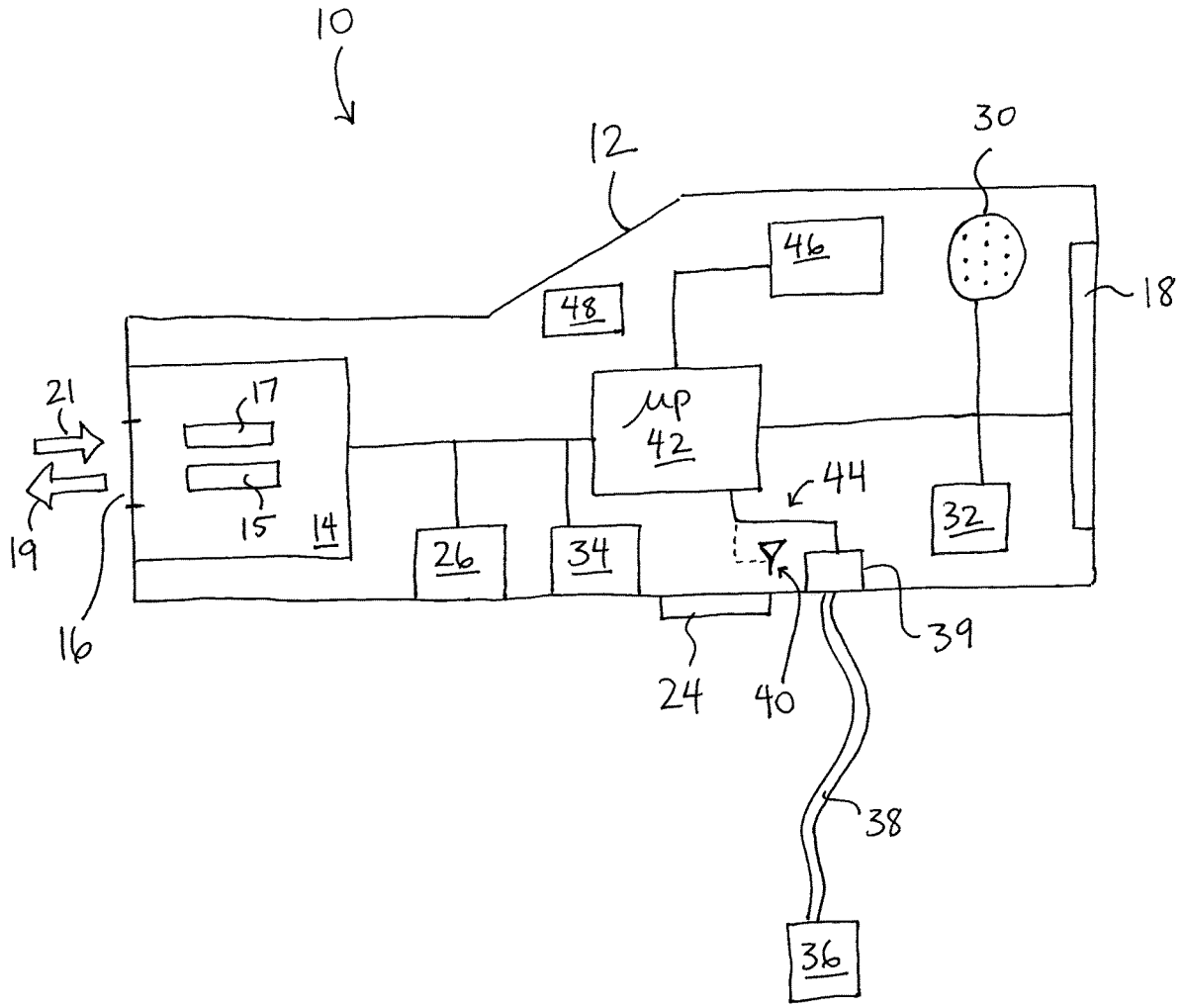
FIG. 2 illustrates a schematic view of the hunting simulation accessory of FIG. 1.

A schematic view of a simulator 10 is shown in FIG. 2. The laser module 14 includes a laser emitter 15 and a photodetector 17, positioned opposite the opening 16 in the housing. The laser emitter 15 generates a laser beam or pulse 19 that exits through the opening 16, and the detector 17 detects a resulting incoming laser 21 after it has reflected off an object. FIG. 2 also shows the display screen 18 at the opposite end of the housing from the laser module 14, and the mount 24, sensor 36, cable 38, wireless transceiver 40 (optional), speaker 30, vibrator 32, and data port 26. Many of these components may be similar in size and function to those found in mobile phones (such as touch screens, batteries, vibration modules, speakers, keypads, etc). The laser module 14 and its components may be similar in size and function to those found in commercial laser rangefinders for hunting, shooting, and sporting activities.

Inside the housing is a processor 42 that communicates with the various electrical components of the system, as indicated by the communication circuits shown in solid lines in FIG. 2. For example, the sensor 36 is electrically connected to the processor 42 via a trigger circuit 44 that communicates a signal from the sensor to the processor, when the sensor is activated by the trigger. The processor also communicates with a memory 46, which stores operating instructions for the processor as well as data files, such as audio, video, and image files, and user preferences. Finally, the system also includes a battery 48 that provides power to the laser, processor, and other components. The battery may be disposable or rechargeable.

The memory 46 includes non-transitory, computer-readable storage media that stores software that is executed by the processor 42 and which controls the operation of the simulation accessory. In an embodiment, the memory 46 includes one or more solid-state storage devices such as flash memory chips. Although the description of computer-readable media contained herein refers to a solid-state storage, the computer-readable storage media can be any available media that can be accessed by the processor 42. That is, computer-readable storage media includes non-transitory, volatile and non-volatile, removable and non-removable media implemented in any method or technology for storage of information such as computer-readable instructions, data structures, program modules or other data. For example, computer-readable storage media includes RAM, ROM, EPROM, EEPROM, flash memory or other solid state memory technology, CD-ROM, DVD, or other optical storage, magnetic cassettes, magnetic tape, magnetic disk storage or other magnetic storage devices, or any other medium which can be used to store the desired information and which can be accessed by the processor. The processor 42 may be a suitable microprocessor that can access the memory 46 and execute the instructions stored in the memory, including receiving signals from the sensor 36, providing user feedback such as sounds and videos, and communicating with the laser module 14.

In an embodiment, the laser module 14 is selected to provide a range that is a reasonable hunting distance, such as 40 yards. The laser emitter and detector can detect a laser reflected from an object at about this distance, but not necessarily further, in order to maintain a reasonable hunting simulation. In other embodiments, the laser emitter and detector may be sized and configured to provide other target ranges.

Figure 3:
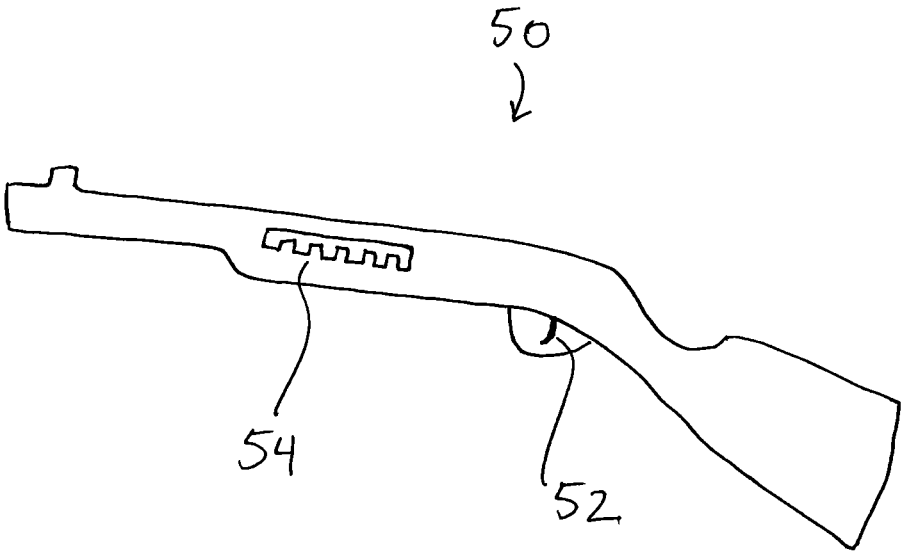
FIG. 3 illustrates a perspective view of a toy firearm for use with the hunting simulation accessory of FIG. 1.

FIG. 3 shows a perspective view of a firearm 50 including a trigger 52 and an accessory rail 54. The firearm may be a shotgun, rifle, air gun, pellet gun, pistol, or other type of gun. The trigger is movable along a path between a first position and a second actuated or fired position. The firearm 50 may be a functional firearm that fires a projectile or ammunition when the trigger is pulled. Such a projectile or ammunition may include bullets, pellets, BB's, or air. Alternatively, the firearm 50 may be a non-functional firearm that does not fire or project anything when the trigger is pulled, such as a toy or replica gun. The toy or replica gun may include components that imitate a real firearm, such as a stock, barrel, trigger, sight, etc. The simulation accessory 10 can be attached to the firearm 50 by attaching the mount 24 (see FIGS. 1 and 2) to the accessory rail 54, similar to how a scope accessory can be mounted to a firearm. This mounting option enables a user to retrofit or transform an existing firearm into a simulated firearm for a simulated hunting experience. Alternatively, the components of the simulator 10 can be integrated into the firearm 50 rather than being removable. In this case, the laser module may be integrated along the barrel 54, and the display screen may be attached to the side of the barrel 54. In another embodiment, the simulation accessory 10 may be integrated with a scope that attaches to a firearm.

Figure 4:
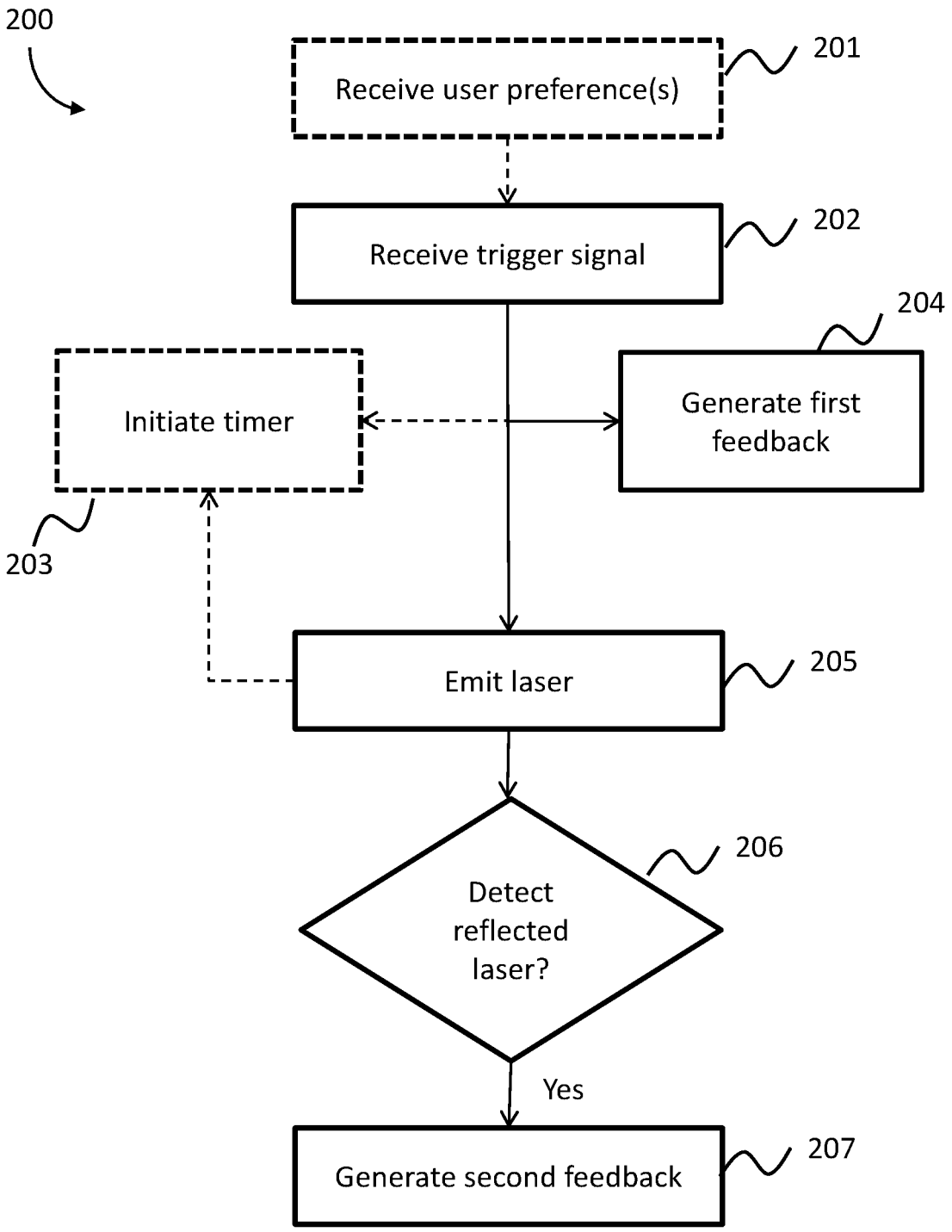
FIG. 4 illustrates a method of simulating a hunting experience, according to an embodiment of the present disclosure.

A method 200 for simulating a hunting experience, according to an embodiment, is shown in FIG. 4. The method 200 optionally includes receiving user preferences 201. For example, the user can download video, image, sound, or other data files to the simulator so that the user can view or listen to desired images and sounds during the hunting experience. The user may also select from default data files included in the simulator, such as sounds of different types of guns being fired, images of animals to be hunted, and videos of animals being shot during a hunt. The user can also change other settings such as volume, turning the vibration mechanism on and off, selecting a type of animal to be hunted, etc.

The method 200 also includes receiving a trigger signal 202. This signal is generated by the sensor 36, described above, when the user pulls the trigger of the firearm. At this point, the method may also include initiating a timer 203. The timer is an optional feature that the user may turn on or off. When enabled, the timer prevents the user from firing more than a set number of shots within a time window, such as 3 shots within 2 seconds, which is a limit on live shots imposed by many hunting regulations. With this timer, the user can better simulate a real hunting experience, simulating the same rules that apply when the user fires live ammunition. A timer may also be generated after emitting the laser, as discussed below, to limit the duration for the second feedback.

The method 200 also includes generating first user feedback 204, after the trigger signal is received. This first user feedback may include audible, visual, or tactile feedback played by the accessory unit through the speaker, display screen, or vibrator. The feedback could include a combination of these responses. In an embodiment, the first feedback includes the sound of a gun being fired, to simulate the firing of live ammunition when the user pulls the trigger. The first feedback may include vibrating the vibrator mechanism to provide tactile feedback such as a shock or vibration to simulate kick or recoil from the firearm.

The method 200 includes emitting a laser 205, after receiving the trigger signal. The laser is emitted along the line of sight of the firearm, toward the object in the user's aim. If the user is not aiming properly at the object, the fired laser may miss the object and not return to the laser module. For example, if the user is aiming at a bird in flight and misses, the laser may not reflect back. However if the user aims correctly and the laser makes contact with the object, such as the bird in flight, then a portion of the laser will be reflected back to the laser module. The method then includes detecting the reflected light 206, and generating second user feedback 207. In an embodiment, the second user feedback is different from the first. For example, the second feedback may indicate a successful shot by playing a second sound (such as an impact, or a louder firearm discharge, or a congratulatory ring, bell, or song, or other sounds) and/or displaying a video or image (such as a video of an animal being shot, or a congratulatory video of a trophy presented or a sports celebration, or other images or videos), and/or vibrating the vibrator mechanism to provide tactile feedback.

The memory on the accessory device may store a variety of sound, image, and video options for the user to choose from in order to customize the hunting experience. For example, the user may select a type of animal being hunted (such as goose, ducks, turkeys, pheasants, deer, elk, and many other game or wild animals), and the accessory may then provide suitable sounds, images and videos of that type of animal being hunted. For example, the user can select a duck, and the accessory will then show a video of a duck falling from the sky as the second feedback. The user may also select data files that are entirely unrelated to hunting, such as a video of a piano falling to the floor, a sports celebration, a cartoon, or a pie eating contest, or sounds such as a raygun, bell, pop, or scream. The user can also select sounds and tactile feedback, with no images or video, or video with no sounds or tactile feedback, or other combinations. These options enable the user to customize his or her hunting experience to be as realistic or as imaginative as desired.

In an embodiment, the first feedback that is given when the trigger signal is received has a first volume or impact, and the second feedback when the reflected laser is detected has a second higher volume or impact, to provide positive reinforcement to the user when the laser successfully hits an object and reflects back. The second feedback may be limited to a certain amount of time after the laser is emitted, so that second feedback is not provided from an unrelated light detected by the laser module. For example, the second feedback may be provided if the reflected laser is detected within 3 seconds of the laser being emitted; otherwise, no second feedback is provided. A timer may be used for this function.

With the described simulator, a user can participate in hunting activities without being constrained by real hunting regulations. For example, when actually hunting to kill, hunters must obtain permits, show proper age and training, use approved equipment, limit the number of rounds of ammunition fired, hunt only approved animals, hunt during an approved time duration or season, and stay physically within a hunting area. By contrast, when hunting with the present simulator, users can experience an outdoor hunt without those constraints. Users may include children, visitors, others not qualified for real hunting, and anyone who wants to enjoy an outdoor activity without harming animals.

It should be noted that components in the figures are shown to demonstrate how they might interact with each other, and are not necessarily to scale.

What is claimed is:

1. A hunting simulation accessory, comprising:

a housing that attaches to a functional or non-functional firearm having a trigger, wherein the housing is removable from the firearm;

a sensor activated by said trigger to generate a trigger signal;

a photodetector supported by the housing and generating a detector signal in response to reflected light entering an opening in the housing;

a display screen supported by the housing;

a user input on the housing or the display screen; and a processor supported by the housing and configured to receive the trigger signal, provide a first feedback to a user in response to receipt of the trigger signal, activate a timer in response to receipt of the trigger signal, determine whether the detector signal from the photodetector is received within a time limit, and indicate to the user a hit shot based on the determination that the detector signal is received within the time limit or a missed shot based on the determination that the detector signal is not received within the time limit, wherein indicating a hit shot includes providing a second feedback to the user, different from the first feedback, wherein the second feedback comprises a video, wherein indicating a missed shot includes withholding the second feedback, and wherein the processor is configured to receive from the user, via the user input, a selection of a type of animal to be hunted, and wherein the video corresponds to the user selection.

2. The hunting simulation accessory of claim 1, further comprising an audio speaker, and wherein the first feedback comprises a sound played on the audio speaker.

3. The hunting simulation accessory of claim 2, wherein the sound comprises a first firearm discharge sound, and wherein the second feedback comprises a second sound louder than the first firearm discharge sound.

4. The hunting simulation accessory of claim 1, wherein the video comprises a pre-stored video of the selected type of animal, displayed on the display screen.

5. The hunting simulation accessory of claim 1, further comprising a cable electrically connecting the sensor to the housing.

6. The hunting simulation accessory of claim 1, wherein the sensor comprises a pressure sensor, a mechanical switch, or an optical sensor.

7. The hunting simulation accessory of claim 1, wherein the display screen comprises a touch screen.

8. The hunting simulation accessory of claim 1, further comprising a vibrator, and wherein the second feedback comprises a vibration response from the vibrator.

9. The hunting simulation accessory of claim 1, further comprising an external data port on the housing, and wherein the processor is further configured to receive data files through the external data port.

10. A method for simulating a hunting experience, comprising:

receiving, at a hunting accessory, a trigger signal from activation of a trigger of a functional or non-functional firearm from which the hunting accessory is removable;

in response to receipt of the trigger signal, generating, at the hunting accessory, a first feedback comprising a first audible, visual, or tactile response;

in response to receipt of the trigger signal, activating, at the hunting accessory, a timer with a time limit;

detecting incoming light at a photodetector of the hunting accessory and generating a detector signal in response;

determining, at the hunting accessory, whether the detector signal is received within the time limit;

upon determining that the detector signal is received within the time limit, indicating to the user a hit shot, by generating, at the hunting accessory, a second feedback comprising a second audible, visual, or tactile response different from the first feedback; and upon determining that the detector signal is not received within the time limit, indicating to the user a missed shot by withholding the second feedback, further comprising receiving, at the hunting accessory, a user selection of a type of animal to be hunted and wherein generating the second feedback comprises providing a sound, an image, or a video that corresponds to the user selection.

11. The method of claim 10, wherein the user selection comprises a type of animal to be hunted, and wherein generating the second feedback comprises displaying a video comprising the type of animal selected.

12. The method of claim 11, wherein generating the second feedback comprises vibrating a vibrator mechanism to provide a tactile response.

13. The method of claim 12, wherein generating the first feedback comprises playing a first firearm discharge sound, and wherein generating the second feedback further comprises playing a second sound louder than the first firearm discharge sound.

14. The hunting simulation accessory of claim 1, wherein the housing is integrated with a scope.

* * * * *